US005925186A

United States Patent [19]

Klimek

[11] Patent Number: 5,925,186

[45] Date of Patent: Jul. 20, 1999

[54] GOLF BALL MARKING TEMPLATE

[76] Inventor: Edward A. Klimek, 21020 134th Way, Sun City West, Ariz. 85375

[21] Appl. No.: 09/158,340

[22] Filed: Sep. 22, 1998

[51] Int. Cl.[6] ..... B05C 13/00

[52] U.S. Cl. ..... 118/500; 118/503; 101/4; 101/35; 101/DIG. 40

[58] Field of Search ..... 118/500, 503; 101/4, 35, DIG. 40

[56] References Cited

U.S. PATENT DOCUMENTS

| | | | |
|---|---|---|---|
| 676,506 | 6/1901 | Knight et al. | 473/268 |
| 849,600 | 4/1907 | Cory | 101/4 |
| 952,501 | 3/1910 | Blumberg | 101/333 |
| 1,167,727 | 1/1916 | Stevens | 101/301 |
| 1,537,685 | 5/1925 | Ladd | 101/4 |
| 1,814,170 | 7/1931 | Long | 101/35 |
| 2,541,358 | 2/1951 | Hirsch | 101/4 |
| 2,561,947 | 7/1951 | Premo | 101/41 |
| 3,019,762 | 2/1962 | Hautz | 118/76 |
| 4,546,644 | 10/1985 | Beny et al. | 73/65 |
| 5,542,680 | 8/1996 | Proudfit et al. | 473/378 |

*Primary Examiner*—Laura Edwards
*Attorney, Agent, or Firm*—Halvorson & Venable, P.C.

[57] ABSTRACT

The present invention is a device for marking golf balls comprising a top portion with at least two apertures and a tube that is centrally located and perpendicularly attached, said tube also having a pair of oppositely located longitudinal slits therein, a bottom portion having at least two apertures and a post that is centrally located and perpendicularly attached, said post on the bottom portion being adapted to slideably fit within the tube located on the top portion, further, two projections on the post extend through the slits thereby limiting movement of the top portion relative to the bottom portion, additionally, the at least two apertures in the top portion are aligned with the at least two apertures in the bottom portion, whereby when a golf ball is placed between opposing apertures in the top portion and the bottom portion, a clamping pressure between the top and bottom portion secures the golf ball in place and the golf ball is then capable of being marked.

10 Claims, 3 Drawing Sheets

GOLF BALL MARKING TEMPLATE

FIELD OF THE INVENTION

The present invention relates to the field of sports ball identification devices. More specifically, the present invention relates to the field of devices designed to mark or otherwise identify golf balls.

BACKGROUND

While playing golf, it is not uncommon for several different individuals on the course to be playing with the same make of golf ball. This leads to the possibility of misidentifying the players ball.

One of the problems commonly encountered while playing golf is the identification of ball in games to the payer or side owning them. This is especially acute when many players in the same course use the same make of ball. Thus it would be useful to create a device that would eliminate disputes and disagreements and unnecessary acrimony during the progress of a game.

There are devices that forcibly imprint a mark within the surface of the golf ball, however, this marring of the surface affects the flight and life-span of the ball. Other devices are complex mechanical devices that provide for a single mark on the ball. Further, those devices that provide for different marks typically require the user to change stamps or marking dies.

Thus, there is a need for a simple device that allows a golf ball to be marked in such a way that part of the mark is always visible, in any lie. Further, there is a need for a device that allows a user to select from a variety of differently marks without resort to complex interchanging of parts.

SUMMARY OF THE INVENTION

It is an object of the present invention to provide a device that aids in the marking of golf balls.

It is another object of the present invention to provide a device that allows different marks to be applied to golf balls.

It is another object of the present invention to provide a device for marking golf balls comprising a top portion with at least two apertures and a tube that is centrally located and perpendicularly attached, said tube also having a pair of oppositely located longitudinal slits therein, a bottom portion having at least two apertures and a post that is centrally located and perpendicularly attached, said post on the bottom portion being adapted to slideably fit within the tube located on the top portion, further, two projections on the post extend through the slits thereby limiting movement of the top portion relative to the bottom portion, additionally, the at least two apertures in the top portion are aligned with the at least two apertures in the bottom portion, whereby when a golf ball is placed between opposing apertures in the top portion and the bottom portion, a clamping pressure between the top and bottom portion secures the golf ball in place and the golf ball is then capable of being marked.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
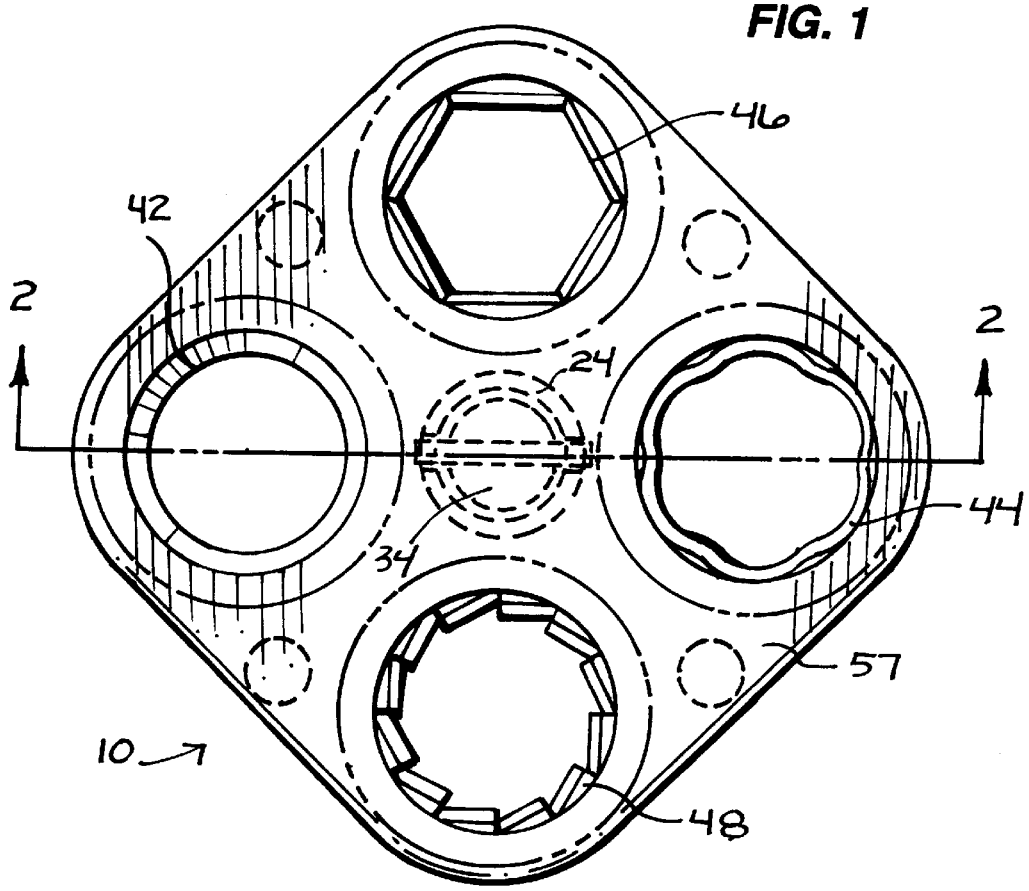
FIG. 1 is a top view of the present invention, note, the top view is identical to the bottom view, except it is a mirror image.
Figure 2:
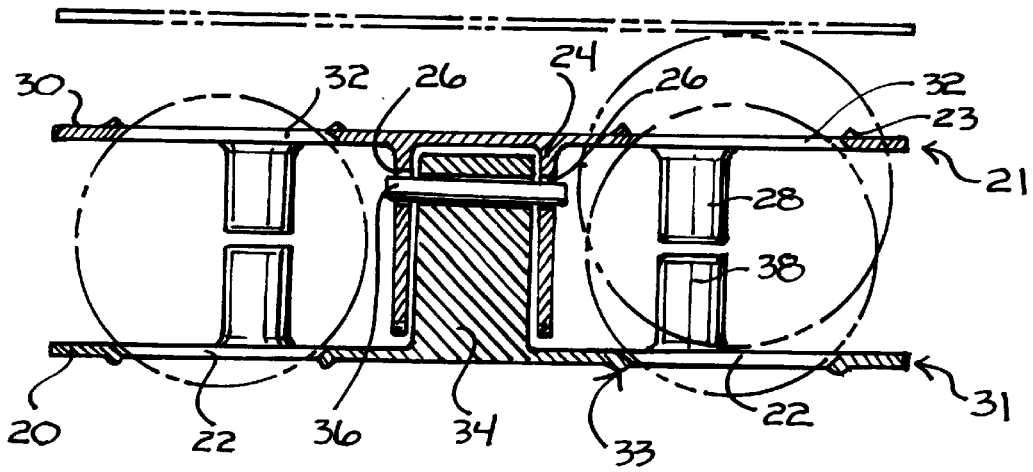
FIG. 2 is a sectional view of the present invention along line 2—2, the dashed plate illustrated in the figure is the top in an open position.
Figure 3:
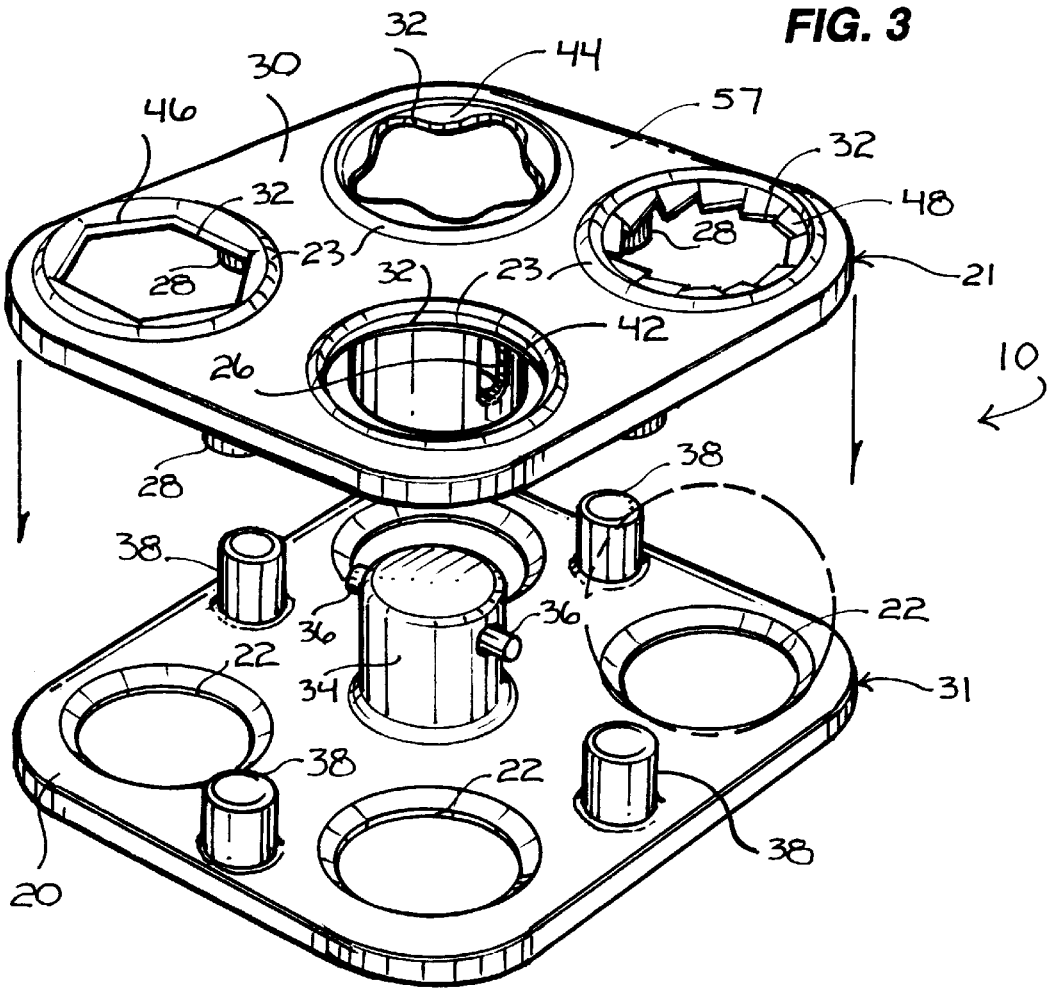
FIG. 3 is an exploded perspective view of the present invention.
Figure 4:
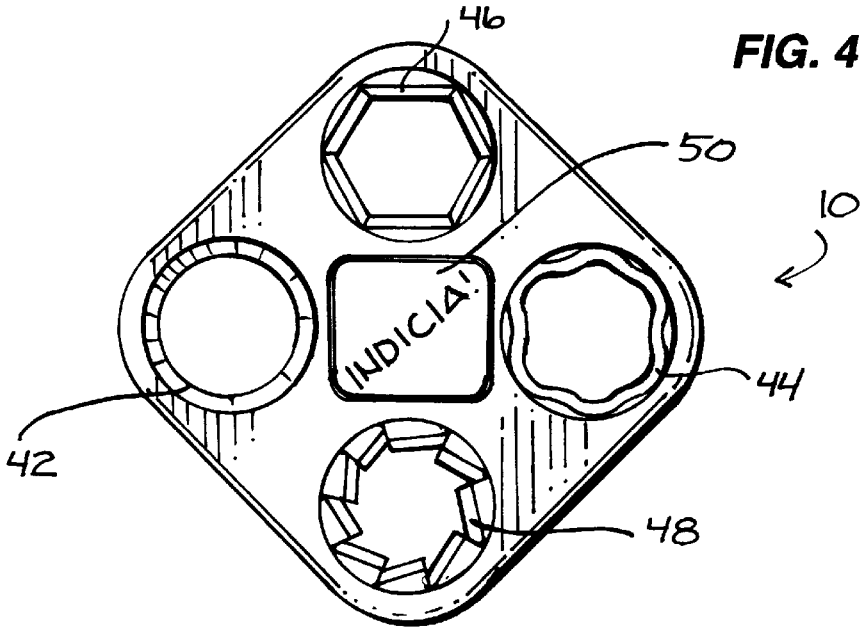
FIG. 4 is a top view of the present invention illustrating a possible placement of printed material.
Figure 5:
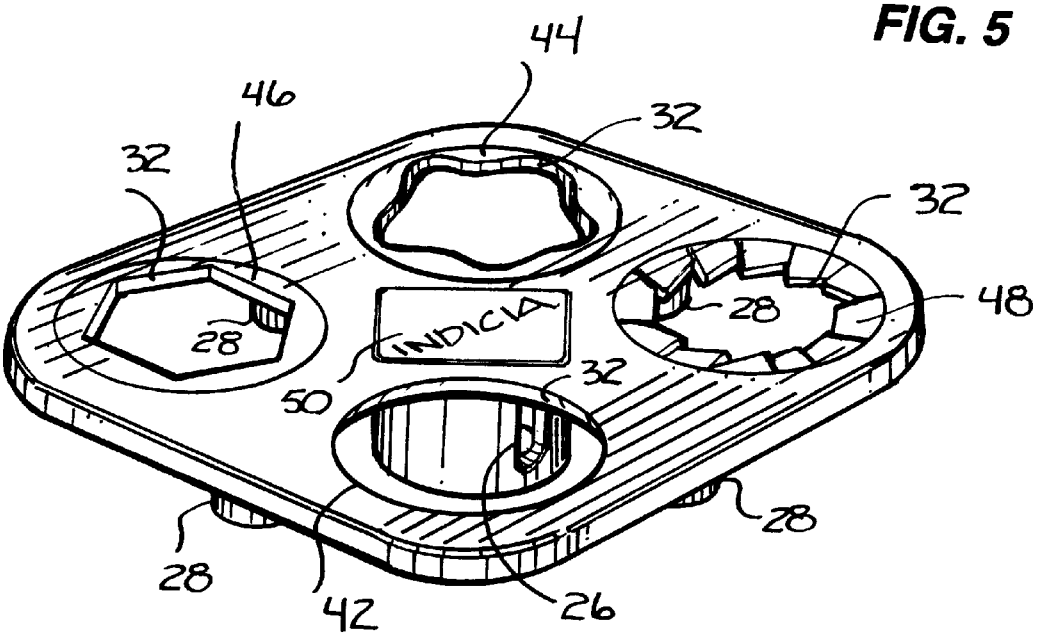
FIG. 5 is a perspective of the top portion of the present invention illustrating a possible placement of printed material.
Figure 6:
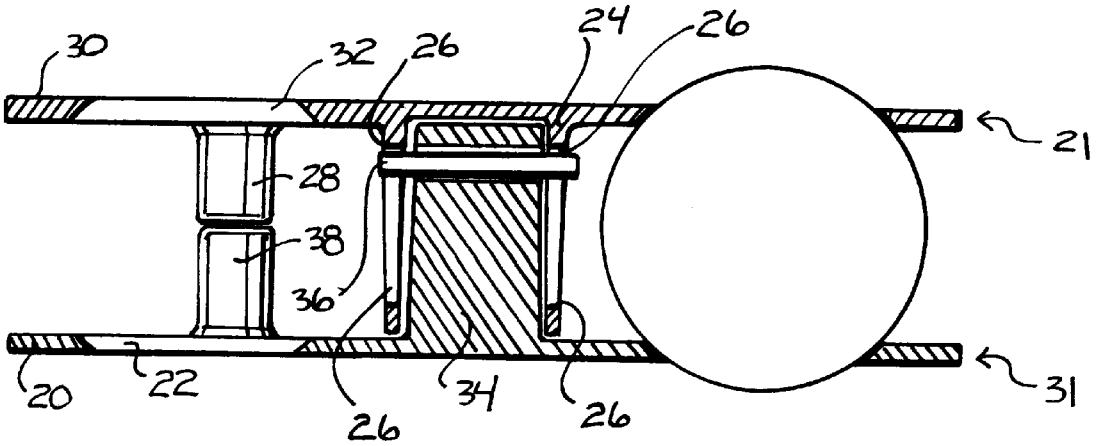
FIG. 6 is a sectional view of the present invention clearly illustrating a closed configuration.

The present invention is a device 10 that is a useful aid in the marking of golf balls. Further, the device 10 of the present invention is useful in making a variety of different marks on a golf ball without resort to complex interchanging of parts or the like.

The device 10 of the present invention comprises a top portion 20 having at least two apertures 22 and a tube 24 that is centrally located and perpendicularly attached to the top portion 20. The tube 24 also has a pair of oppositely located longitudinal slits 26 therein that extend through the walls of the tube 24. The device 10 also has a bottom portion 30 having at least two apertures 32 and a post 34 that is centrally located and perpendicularly attached to the bottom portion 30. The post 34 on the bottom portion 30 is adapted to slideably fit within the tube 24 located on the top portion 20. Furthermore, there are two projections 36 on the post 34 that extend through the slits 26 in tube 24 thereby limiting movement of the top portion 20 relative to the bottom portion 30.

Additionally, the at least two apertures 22 in the top portion 20 are aligned with the at least two apertures 32 in the bottom portion 30, whereby when a golf ball is placed between opposing apertures in the top portion 20 and the bottom portion 30, a clamping pressure between the top and bottom portions, 20 and 30, secures the golf ball in place and the golf ball is then capable of being marked.

The shape of the top and bottom portions, 20 and 30, is a substantially rectangular and flat. However, this shape may vary to include other shapes such as substantially triangular or may even be an outline of a corporate logo or the like. The only requirement is that the device 10 be sufficiently large enough to contain at least two marking apertures, 22 and 32, in the top and bottom portions, 20 and 30. In deed, there is no requirement that the top portion 20 have the exact same outline as the bottom portion 30.

There are preferably four apertures, 22 and 32, in the top and bottom portions, 20 and 30, one for each corner of the preferred substantially rectangular shape. The number of apertures may vary, providing that there are at least two in each of the top and bottom portions, 20 and 30. In deed, there is not requirement that the number of apertures 22 in the top portion 20 be the same and the number of apertures 32 in the bottom portion 30. However, there is the requirement that any apertures 22 in the top portion 20 are capable of being placed in a co-axial portion with the apertures 32 in the bottom portion 30. Thus, each aperture 22 in the top portion 20 may be rotated into a coaxial relationship with each aperture 32 in the bottom portion 30.

This requirement of coaxial relationship of the apertures is necessary for when a golf ball is inserted into the device 10. The golf ball is placed between opposing apertures in the top and bottom portion, 20 and 30, and a clamping pressure is placed on the outside of the device thereby forcing the top and bottom portions, 20 and 30 toward each other. This clamping pressure then holds the golf ball in the device 10 until it is released. In this manner, the golf ball is capable of being marked through use of the outline of the apertures between which the golf ball is placed. Each of the apertures, 22 and 32, in the device 10 may have a different shape 40, preferably the shape is selected from the group comprising of a circle shape 42, a scallop shape 44, a hexagonal shape 46, and a ratchet shape 48. However, alternate shapes may be employed, such as corporate logos and the like.

The apertures, 22 and 32, in the device 10 may further have outwardly projecting raised edges, 23 and 33, respectively, thereby allowing a more snug fit of a golf ball into the device.

The top portion 20 of the device 10 may further include at least two, preferably four, inwardly projecting stop posts 28, and the bottom portion 30 further includes at least two, preferably four, inwardly projecting stop posts 38. The stop posts 28 on the top portion 20 are located in alignment with the stop posts 38 on the bottom portion 38. Thus, when a golf ball is not in the device, the stop posts 28 on the top portion 20 will come into contact with the stop posts 38 on the bottom portion 30 thereby limiting the inward movement of the top and bottom portions, 20 and 30. The stop posts, 28 and 38, are preferably located adjacent the edges, 21 and 31, of the top and bottom portions, 20 and 30, respectively.

Since the device 10 of the present invention is ideal for advertising give-aways, in the preferred embodiment printed material 50 is placed upon an external surface 51 of at least one of either the top portion 20 or the bottom portion 30.

While these descriptions directly describe the above embodiments, it is understood that those skilled in the art may conceive modifications and/or variations to the specific embodiments shown and described herein. Any such modifications or variations that fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A device for holding golf balls to be marked comprising a top portion having at least two apertures and a tube that is centrally located and perpendicularly attached, said tube also having a pair of oppositely located longitudinal slits therein, a bottom portion having at least two apertures and a post that is centrally located and perpendicularly attached, said post on the bottom portion to slideably fit within the tube located on the top portion, further, two projections on the post extend through the slits thereby limiting movement of the top portion relative to the bottom portion, additionally, the at least two apertures in the top portion are aligned with the at least two apertures in the bottom portion, whereby when a golf ball is placed between opposing apertures in the top portion and the bottom portion, a clamping pressure between the top and bottom portions secures the golf ball in place and the golf ball is then available to be marked.

2. A device as in claim 1 wherein the top and bottom portions are substantially rectangular in shape and the at least two apertures in the top portion is four apertures and the at least two apertures in the bottom portion are four apertures.

3. The device as in claim 2 wherein the four apertures of the top and bottom portions each have a different shape selected from the group comprising of a circle shape, a scallop shape, a hexagonal shape and a ratchet shape.

4. The device as in claim 3 wherein the top portion further includes four inwardly projecting stop posts, and the bottom portion further includes four inwardly projecting stop posts, wherein the stop posts on the top portion are located in alignment with the stop posts on the bottom portion, whereby when a golf ball is not in the device, the stop posts on the top portion will come into contact with the stop posts on the bottom portion thereby limiting the inward movement of the top and bottom portions.

5. The device as in claim 4 wherein the four shaped apertures of the top and bottom portion further have outwardly projecting raised edges thereby allowing a more snug fit of a golf ball into the device.

6. The device as in claim 5 wherein printed material is affixed upon an external surface of at least one of either the top portion or the bottom portion.

7. The device as in claim 1 wherein the at least two shaped apertures of the top and bottom portion further have outwardly projecting raised edges thereby allowing a more snug fit of a golf ball into the device.

8. The device as in claim 7 wherein the top portion further includes at least two inwardly projecting stop posts, and the bottom portion further includes at least two inwardly projecting stop posts, wherein the stop posts on the top portion are located opposite the stop posts on the bottom portion, whereby when a golf ball is not in the device, the stop posts on the top portion will come into contact with the stop posts on the bottom portion thereby limiting the inward movement of the top and bottom portions.

9. The device as in claim 8 wherein the stop posts are located adjacent edges of the top and bottom portions.

10. The device as in claim 9 wherein printed material is affixed upon an external surface of at least one of either the top portion or the bottom portion.

* * * * *